US009027794B2

(12) United States Patent
Mahar

(10) Patent No.: US 9,027,794 B2
(45) Date of Patent: May 12, 2015

(54) LIQUID CONTROL MOBILITY (LCM) RECEPTACLES

(71) Applicant: Edward Mahar, Scarborough, ME (US)

(72) Inventor: Edward Mahar, Scarborough, ME (US)

(73) Assignee: Edward Mahar, Scarborough, ME (US)

( * ) Notice: Subject to any disclaimer, the term of this patent is extended or adjusted under 35 U.S.C. 154(b) by 0 days.

(21) Appl. No.: 14/062,679

(22) Filed: Oct. 24, 2013

(65) Prior Publication Data

US 2014/0110436 A1 Apr. 24, 2014

Related U.S. Application Data

(60) Provisional application No. 61/717,891, filed on Oct. 24, 2012.

(51) Int. Cl.
*B67D 7/84* (2010.01)
*B67D 7/78* (2010.01)

(52) U.S. Cl.
CPC ..... *B67D 7/78* (2013.01)

(58) Field of Classification Search
USPC ..... 137/356, 363, 376, 377; 220/560.03, 220/562–565, 567, 567.1, 567.2, 567.3, 220/500, 523, 524; 222/478, 318, 424, 192, 222/189.06, 189.08, 189.09, 189.1, 173, 222/182, 153.01, 153.03, 130, 131; 312/237
See application file for complete search history.

(56) References Cited

U.S. PATENT DOCUMENTS 1,394,742 A * 10/1921 Kramer ..... 280/838
4,014,361 A * 3/1977 Rodieck ..... 137/122
4,948,010 A * 8/1990 Wiggins ..... 137/398
5,284,191 A * 2/1994 McGarvey ..... 141/198
5,400,924 A * 3/1995 Brodie ..... 222/108
5,538,052 A * 7/1996 Harp ..... 141/86
5,570,714 A * 11/1996 Magish ..... 137/202
5,692,647 A * 12/1997 Brodie ..... 222/173
5,865,346 A * 2/1999 Del Zotto ..... 222/108
5,950,872 A * 9/1999 Webb ..... 222/131
5,975,371 A * 11/1999 Webb ..... 222/173
6,640,997 B1 * 11/2003 Anderson ..... 222/2
7,070,096 B2 * 7/2006 Muller et al. ..... 235/381
2002/0050302 A1 * 5/2002 Wertheim ..... 141/18
2013/0307382 A1 * 11/2013 Garrison ..... 312/215

* cited by examiner

*Primary Examiner* — Patrick M Buechner

(57) ABSTRACT

The present disclosure is directed to a liquid control mobility receptacle for storage, filtration, distribution, and transportation of liquids. The liquid control mobility receptacle has a main body that encloses a front security enclosure, a pump enclosure, and a main enclosure for storage of liquids. The main enclosure is disposed between the pump enclosure and the front security enclosure. An internal power source is enclosed within the front security enclosure and is electrically coupled to a pump, which is enclosed in pump enclosure. A fill line is provided to pump liquid from a liquid source into the main enclosure. A recirculation line is provided to recirculate fluid in within the main enclosure. A supply line is provided for pumping fluid out of the main enclosure. In some examples, the liquid control mobility receptacle has an internal power source that is a diesel engine, and the security enclosure further houses a fuel enclosure that is fluidly coupled to the diesel engine. In some further examples, the liquid control mobility receptacle has an internal power source that is a solar power generator, and a top wall of the security enclosure further includes a plurality of solar panels that are electrically coupled to the solar power generator.

20 Claims, 2 Drawing Sheets

LCM - LIQUID CONTROL MOBILITY

LCM - LIQUID CONTROL MOBILITY

LCM - LIQUID CONTROL MOBILITY

LIQUID CONTROL MOBILITY (LCM) RECEPTACLES

BACKGROUND

The present disclosure relates generally to liquid storage receptacles. In particular, liquid control mobility receptacles are described.

Large tanks or receptacles are currently provided for storing and dispensing fluids for use at a gas or oil well site. Such tanks or receptacles are also used to receive and hold fluids and chemicals at industrial plants. They are also used at environmental sites to aid in the storage and subsequent transportation of spilled liquids or chemicals. Accordingly, there is a need for liquid control mobility receptacles that are not only transportable, but are capable of operating from a self-supplied electrical source.

Known liquid control mobility receptacles are not entirely satisfactory for the range of applications in which they are employed. For example, existing liquid control mobility receptacles are not configured to be self-sustaining units. In other words, existing liquid control mobility receptacles require set up of the receptacle and further require an external power source to function. This may be a disadvantage when liquid control mobility, receptacles are used in remote environments or during natural disasters where external power may not be available.

In addition, conventional liquid control mobility receptacles are not flexible enough in their structural arrangement so that they may be used with either diesel-powered or solar-powered generator units. For example, if a liquid control mobility receptacle is used in an environment with high sun exposure and/or in an environment where fuel is not readily available, a solar power source may be desirable. In another example, if the liquid control mobility receptacle is used in second environment that has minimal sun exposure and/or in an environment where fuel is readily available, an engine power source may be desirable.

Thus, there exists a need for liquid control mobility receptacles that improve upon and advance the design of known liquid control mobility receptacles. Examples of new and useful liquid control mobility receptacles relevant to the needs existing in the field are discussed below.

SUMMARY

The present disclosure is directed to a liquid control mobility receptacle for storage, filtration, distribution, and transportation of liquids. The liquid control mobility receptacle has a main body that encloses a front security enclosure, a pump enclosure, and a main enclosure for storage of liquids. The main enclosure is disposed between the pump enclosure and the front security enclosure. An internal power source is enclosed within the front security enclosure and is electrically coupled to a pump, which is enclosed in pump enclosure. A fill line is provided to pump liquid from a liquid source into the main enclosure. A recirculation line is provided to recirculate fluid in within the main enclosure. A supply line is provided for pumping fluid out of the main enclosure. In some examples, the liquid control mobility receptacle has an internal power source that is a diesel engine, and the security enclosure further houses a fuel enclosure that is fluidly coupled to the diesel engine. In some other examples, the liquid control mobility receptacle has an internal power source that is a solar power generator, and a top wall of the security enclosure further includes a plurality of solar panels that are electrically coupled to the solar power generator.

DETAILED DESCRIPTION

The disclosed liquid control mobility receptacles will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of liquid control mobility receptacle examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
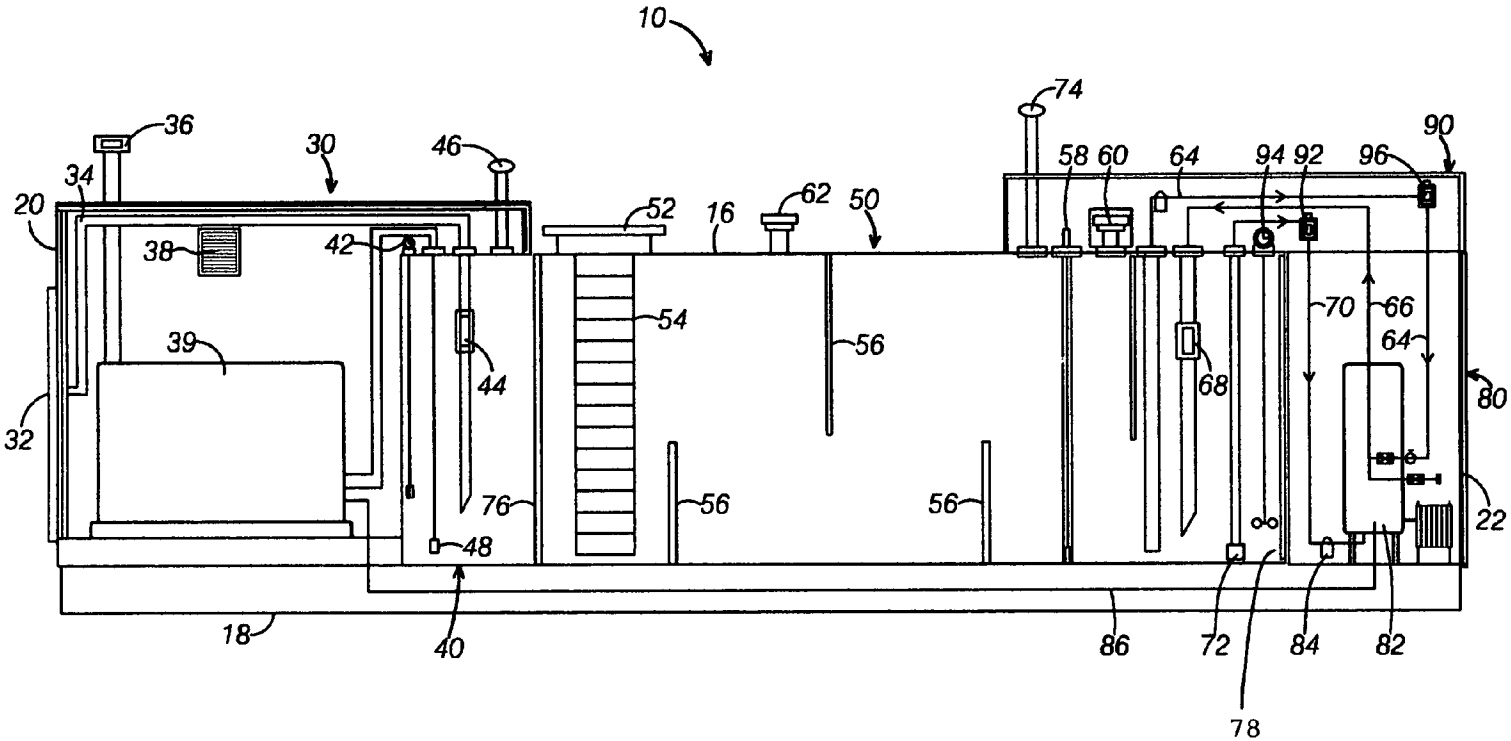
FIG. 1 is a left-side elevational view, of a first example of a liquid control mobility receptacle in use with a diesel-powered generator unit.

With reference to FIG. 1, a first example of a liquid control mobility (LCM) receptacle 10 includes: a front security enclosure 30, a fuel enclosure 40, a main enclosure 50, a pump enclosure 80, an equipment box 90, and a diesel-powered generator 39. LCM receptacle 10 functions to allow the storage, filtration, distribution, and transportation of a variety of liquids, including, but not limited to, petroleum products, liquid chemicals, and water. Alternatively, the LCM receptacle may utilize solar panels as a means for generating electrical power.

As can be seen in FIG. 1, LCM receptacle 10 includes at least two side walls 12 and 14, a top wall 16, a base 18, a front wall 20, and a rear wall 22. Each of the walls making up LCM receptacle 10 are formed of steel to enclose a sealable area capable of containing a variety of liquids or fluids. Alternatively, the walls of LCM receptacle 10 may be made from Kevlar or any other suitable material known or yet to be discovered.

Front security enclosure 30 is situated proximal a front end of LCM receptacle 10. Side walls 12 and 14, base 18, and front wall 20 of LCM receptacle 10 are shared with front security enclosure 30. Top wall 16 of LCM receptacle 10 is shared with front security enclosure 30, but is slightly raised in the area over fuel enclosure 40 and front security enclosure 30. The ability to restrict access to front security enclosure 30 is achieved by selectively lockable dual-access doors 32, which are disposed adjacent to front wall 20.

Front security enclosure 30 houses a diesel-fueled generator unit 39 that is used as the sole power-generating source for LCM receptacle 10. Generator unit 39 provides electrical power to LCM receptacle 10 so that no external power sources are needed. Because generator unit 39 requires diesel fuel to operate, an exhaust duct 36 attached to generator unit 39 is fed through top wall 16, and functions to evacuate toxic diesel fumes from front security enclosure 30. Additionally, an air vent 38 exists within front security enclosure 30 to aid in the evacuation of any residual diesel fumes generated by generator unit 39.

Fill line 34 runs adjacent to front wall 20 and along top wall 16 and into the top of fuel enclosure 40. Fill line 34 provides a means for piping in diesel fuel to fuel enclosure 40. Fill line 34 is also used to pipe diesel fuel from fuel enclosure 40 to generator unit 39.

With continuing reference to FIG. 1, fuel enclosure 40 is defined by an enclosed area within front security enclosure 30. Fuel enclosure 40 includes: a fuel gauge 42, an over-fill valve 44, a vent 46, and a foot valve 48. Fuel enclosure 40 functions to store and provide diesel fuel to generator unit 39. Fuel gauge 42 located on top of fuel enclosure 40 provides an indication of diesel fuel remaining in fuel enclosure 40. Over-fill valve 44 ensures that fuel enclosure 40 is not mistakenly overfilled with diesel fuel. Foot valve 48 ensures that diesel fuel pumped from fuel enclosure 40 to generator unit 39 is not allowed to flow back into fuel enclosure 40. Air vent 46 is located on top of fuel enclosure 40 to allow diesel-fuel fumes to escape the enclosed space of fuel enclosure 40.

Still referring to FIG. 1, main enclosure 50 functions as the primary storage area for the various types of liquids that are transported and distributed by LCM receptacle 10. Main enclosure 50 is an expanse situated between fuel enclosure 40 to the front, and pump enclosure 80 to the rear. Sidewalls 12 and 14, top wall 16, and base 18 of LCM receptacle 10 are shared with main enclosure 50 and serve to completely enclose the fluid storage area of fuel enclosure 40. Additionally, double-bulkhead walls 76 and 78 ensure that the fluids stored in main enclosure 50 do not leak or seep into either fuel enclosure 40 or pump enclosure 80, and visa-versa.

Access into main enclosure 50 is accomplished through the use of a manway 52 and an internal ladder 54. Manway 52 can be up to 30-inches in diameter and includes a selectively-engaged lock-out point for controlling access to main enclosure 50. Internal ladder 54 provides a means for allowing a user to descend into main enclosure 50.

A plurality of internal baffles 56 are positioned in various locations inside of main enclosure 50. Internal baffles 56 are partition-like members that function to deflect, dampen or regulate the surge of contents within main enclosure 50, but which do not divide main enclosure 50 into content holding compartments. A recirculation line 64 and a fill line 66 run through main enclosure 50, and to pump enclosure 80. Recirculation line 64 and fill line 66 function to recirculate the liquid contents as well as fill the expanse of main enclosure 50, respectively. Supply line 70 provides a means for the stored liquid to be transferred from main enclosure 50 to a pump unit 82.

An overfill valve 68 ensures that main enclosure 50 is not mistakenly filled beyond its capacity. A leak sensor 58 is employed within main enclosure 50 and provides an affirmative warning if any of the stored fluid leaks into an adjoining enclosure or to any point outside of main enclosure 50.

A primary emergency vent 60 and a secondary emergency vent 62 are located on top of main enclosure 50. Primary emergency vent 60 and secondary emergency vent 62 operate to relieve an over-pressure condition within main enclosure 50. When main enclosure 50 reaches a determined pressure, primary emergency vent 60 and secondary emergency vent 62 allow for the release of the excess pressure. Air vent 74 located on top of main enclosure 50 provides another means for exhausting toxic liquid fumes from the enclosed space.

Pump enclosure 80 shares top wall 16, sidewalk 12 and 14, rear wall 22, and base 18 with LCM receptacle 10, and includes pump unit 82, an inlet/outlet filter 84, and an electrical line 86. Pump unit 82 is utilized to transfer fluids to and from main enclosure 50. Pump unit 82 receives operation power from generator unit 39 through electrical line 86. Further, inlet/outlet filter 84 is connected in series with pump unit 82 through supply line 70 to ensure proper filtering of fluids being transferred to and from main enclosure 50. Additionally, a pump suction strainer 72 placed further upstream of pump unit 82, and in series with inlet/outlet filter 84, aids in the filtering of unwanted materials entering into pump unit 82.

Lastly, FIG. 1 also shows an equipment box 90 located directly above a rear portion of main enclosure 50 and the entirety of pump enclosure 80. Equipment box 90 houses at least two anti-siphon valves 92 and 96, a fluid gauge 94, air vent 74, leak sensor 58, and primary emergency vent 60. Anti-siphon valves 92 and 96 function to limit the inadvertent transfer of fluids from main enclosure 50. Restricting the inadvertent transfer of fluids is accomplished by a first anti-siphon valve 92 being located in series with supply line 70, while a second anti-siphon valve 96 is located in series with recirculation line 64. Fluid gauge 94 provides a current read-out of the volume of fluid stored in main enclosure 50. Additionally recirculation line 64, fill line 66, and supply line 70 are routed through equipment box 90 to allow recirculation, and transfer of fluids between main enclosure 50 and pump enclosure 80, respectively.

Figure 2:
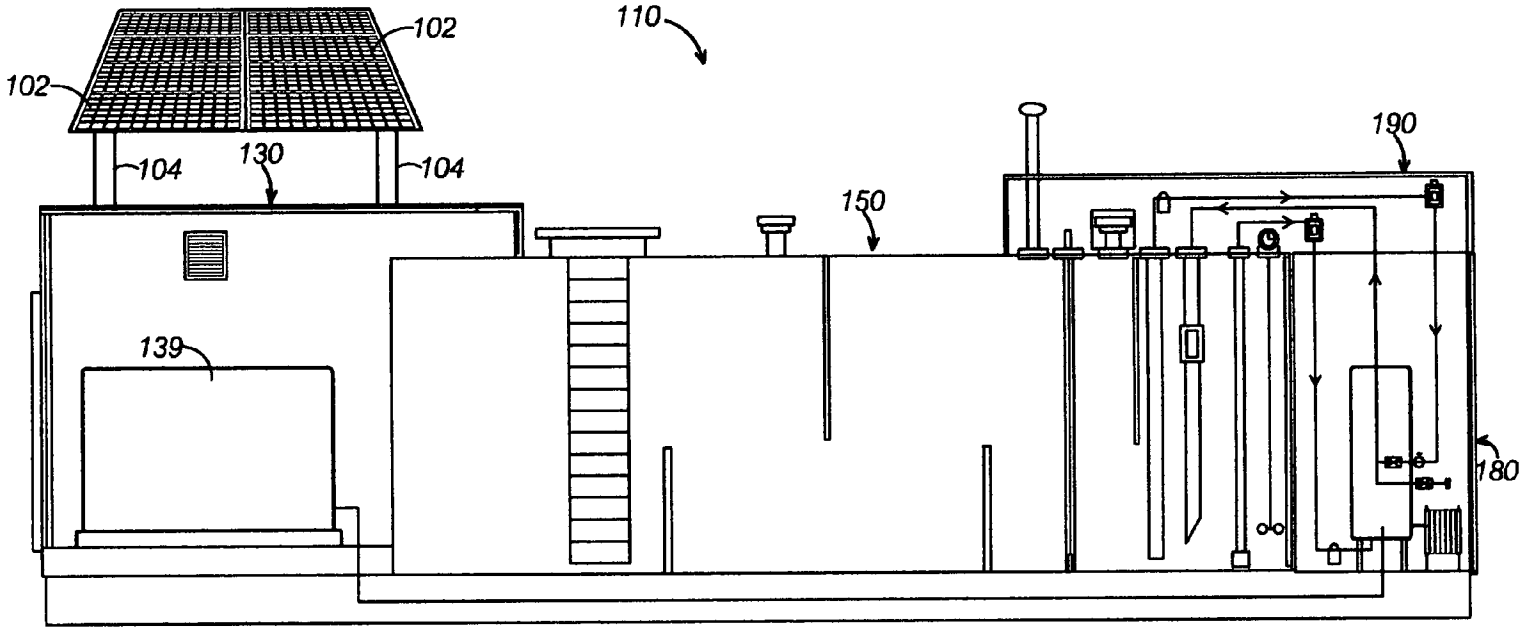
FIG. 2 is a left-side elevational view, of a second example of a liquid control mobility receptacle in use with a solar-powered generator unit.

Turning attention to FIG. 2, a second example of an LCM receptacle 110 will now be described. LCM receptacle 110 includes many similar or identical features to LCM receptacle 10. More specifically, LCM receptacle 110 includes many similar or identical features to those features described above relating to the main enclosure, the pump enclosure, and the equipment box of LCM receptacle 10. Thus, for the sake of brevity, each feature of LCM receptacle 110 will not be redundantly explained. Rather, key distinctions between LCM receptacle 110 and LCM receptacle 10 will be described in detail and the reader should reference the discussion above for features substantially similar between the two LCM receptacles.

As can be seen in FIG. 2, LCM receptacle 110 includes: a front security enclosure 130, a main enclosure 150, a pump enclosure 180, an equipment box 190, a plurality of solar panels 102, and a solar-powered generator unit 139. LCM receptacle 110 functions to allow the storage, filtration, distribution, and transportation of a variety of liquids, including, but not limited to, petroleum products, liquid chemicals, and water. In this aspect of the invention, LCM receptacle 110 provides electrical power to pump enclosure 180 through the use of solar-powered generator unit 139.

Turning attention to FIG. 2, plurality of solar panels 102 are fixedly attached to a plurality of extension members 104 that are likewise, fixedly attached to a top surface of front security enclosure 130. Extension members 104 allow for varied positioning of solar panels 102 in order to better collect the sun's rays. Generator unit 139 then converts solar energy captured by solar panels 102 and converts that energy into electrical energy for use by pump unit 182 and any other devices of LCM receptacle 110 that require electricity to function.

In this aspect of the invention, the volume of main enclosure 150 has been expanded as there is no longer a need for a diesel fuel enclosure 40. Thus, an increased capacity to store and transport a variety of liquids has been realized when a solar-powered generator unit is used with LCM receptacle 110.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring, nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A liquid control mobility receptacle for storing, filtering, distributing, and transporting liquids, the liquid control mobility receptacle comprising:

a receptacle main body;

a front security enclosure substantially enclosed within the receptacle main body and sharing at least one wall with the receptacle main body;

an internal power source substantially enclosed within the front security enclosure;

a pump enclosure substantially enclosed within the receptacle main body;

a pump unit provided within the pump enclosure for pumping liquid through the liquid control mobility receptacle, the pump electrically coupled to the internal power source;

a main enclosure for storing liquids and substantially enclosed within the receptacle main body, the main enclosure disposed between the pump enclosure and the front security enclosure within the receptacle main body;

a fill line fluidly coupling a liquid source to the pump unit and further coupling the pump unit to the main enclosure for transporting liquid into the main enclosure;

a recirculation line fluidly coupling the main enclosure to the pump unit for recirculating fluid within the main enclosure; and a supply line fluidly coupling the main enclosure to the pump unit for dispensing liquid out of the main enclosure.

2. The liquid control mobility receptacle of claim 1, wherein the internal power source is a diesel engine fluidly coupled to a fuel enclosure, the fuel enclosure housed within the front security enclosure.

3. The liquid control mobility receptacle of claim 1, wherein the internal power source is a solar power generator, the solar power generator electrically coupled to a plurality of solar panels mounted to a top wall of the receptacle main body.

4. The liquid control mobility receptacle of claim 1, further comprising one or more selectively lockable dual-access doors coupled to the front security enclosure at the at least one shared wall, the one or more selectively lockable dual-access doors providing access to the internal power source.

5. The liquid control mobility receptacle of claim 1, further comprising an air vent disposed in a wall of the front security enclosure.

6. The liquid control mobility receptacle of claim 1, further comprising a pump suction strainer coupled to an inlet of the supply line and an inlet outlet filter connected in series with the pump unit through the supply line, the pump suction filter and the inlet outlet filter configured to filter liquids.

7. The liquid control mobility receptacle of claim 1, further comprising a leak sensor coupled to the main enclosure and configured to detect fluid leaks into one or more of the internal power source enclosure, the pump enclosure, and outside of the receptacle main body.

8. The liquid control mobility receptacle of claim 1, further comprising a fluid gauge coupled to the main enclosure for providing a readout of a volume of fluid stored inside the main enclosure.

9. The liquid control mobility receptacle of claim 1, further comprising one or more internal baffles disposed within the main enclosure, the one or more baffles configured to deflect, dampen, and regulate fluid within the main enclosure.

10. The liquid control mobility receptacle of claim 1, wherein the receptacle main body, the internal power source enclosure, the pump enclosure, and the main enclosure are comprised of steel.

11. A liquid control mobility receptacle for storing, filtering, distributing, and transporting liquids, the liquid control mobility receptacle comprising:

a receptacle main body;

a front security enclosure substantially enclosed within the receptacle main body and sharing at least one wall with the receptacle main body;

an internal power source substantially enclosed within the front security enclosure, the internal power source being one of a diesel engine and a solar power generator;

a pump enclosure substantially enclosed within the receptacle main body;

a pump unit provided within the pump enclosure for pumping liquid through the liquid control mobility receptacle, the pump unit electrically coupled to the internal power source;

a main enclosure for storing liquids, the main enclosure substantially enclosed within the receptacle main body and disposed between the pump enclosure and the front security enclosure within the receptacle main body;

a fill line fluidly coupling a liquid source to the pump unit and further coupling the pump unit to the main enclosure for transporting liquid into the main enclosure;

a recirculation line fluidly coupling the main enclosure to the pump unit for recirculating fluid within the main enclosure; and a supply line fluidly coupling the main enclosure to the pump unit for dispensing liquid out of the main enclosure.

12. The liquid control mobility receptacle of claim 11, wherein when the internal power source is the diesel engine, the liquid control mobility receptacle further comprises a fuel enclosure housed within the front securing enclosure.

13. The liquid control mobility receptacle of claim 11, wherein when the internal power source is the solar power generator, the liquid control mobility receptacle further comprises a plurality of solar panels mounted to a top wall of the receptacle main body, the plurality of solar panels electrically coupled to the solar power generator.

14. The liquid control mobility receptacle of claim 11, further comprising one or more selectively lockable dual-access doors coupled to the front security enclosure at the at least one shared wall, the front security enclosure substantially enclosing and providing access to the internal power source.

15. The liquid control mobility receptacle of claim 11, further comprising a pump suction strainer coupled to an inlet of the supply line and an inlet outlet filter connected in series with the pump unit through the supply line, the pump suction filter and the inlet outlet filter configured to filter liquids.

16. The liquid control mobility receptacle of claim 11, further comprising a leak sensor coupled to the main enclosure, the leak sensor configured to detect fluid leaks into one or more of the internal power source enclosure, the pump enclosure, and outside of the receptacle main body.

17. The liquid control mobility receptacle of claim 11, further comprising one or more internal baffles disposed within the main enclosure, the one or more baffles deflecting, dampening, and regulating fluid within the main enclosure.

18. The liquid control mobility receptacle of claim 11, further comprising:

an overfill valve fluidly coupled to the main enclosure to prevent liquid overfill beyond a capacity of the main enclosure; and a fluid gauge coupled to the main enclosure for providing a readout of a volume of fluid stored inside the main enclosure.

19. The liquid control mobility receptacle of claim 11, further comprising a first anti-siphon valve fluidly coupled to the recirculation line and a second anti-siphon valve fluidly coupled to the supply line, the first anti-siphon valve and the second anti-siphon valve provided to limit inadvertent transfer of liquid from the main enclosure.

20. A liquid control mobility receptacle for storing, filtering, distributing, and transporting liquids, the liquid control mobility receptacle comprising:

a receptacle main body;

a front security enclosure substantially enclosed within the receptacle main body and sharing at least one wall with the receptacle main body;

an internal power source substantially enclosed within the front security enclosure, the internal power source being a diesel engine, the diesel engine fluidly coupled to a fuel enclosure, the fuel enclosure housed within the front security enclosure, one or more selectively lockable dual-access doors coupled to the front security enclosure at the at least one shared wall for providing access to the diesel engine and the fuel enclosure, an air vent disposed in a wall of the front security enclosure for venting of diesel fumes;

a pump enclosure substantially enclosed within the receptacle main body;

a pump unit provided within the pump enclosure to drive liquid through the liquid control mobility receptacle, the pump unit electrically coupled to the internal power source;

a main enclosure for storing liquids, the main enclosure substantially enclosed within the receptacle main body and disposed between the pump enclosure and the front security enclosure within the receptacle main body;

a fill line fluidly coupling a liquid source to the pump unit and further coupling the pump unit to the main enclosure for transporting liquid into the main enclosure;

a recirculation line fluidly coupling the main enclosure to the pump unit for recirculating fluid within the main enclosure; and a supply line fluidly coupling the main enclosure to the pump unit for dispensing liquid out of the main enclosure.

* * * * *